United States Patent [19]

Yamagishi et al.

[11] Patent Number: 4,710,242

[45] Date of Patent: Dec. 1, 1987

[54] MATERIAL FOR TEMPERATURE SENSITIVE ELEMENTS

[75] Inventors: Wataru Yamagishi, Kawasaki; Masato Sagawa, Yokohama, both of Japan

[73] Assignee: Fujitsu Limited, Kawasaki, Japan

[21] Appl. No.: 871,175

[22] Filed: Jun. 3, 1986

Related U.S. Application Data

[63] Continuation of Ser. No. 480,031, Mar. 29, 1983, abandoned, which is a continuation of Ser. No. 290,973, Aug. 7, 1981, abandoned.

[30] Foreign Application Priority Data

Nov. 8, 1980 [JP] Japan ..... 55-109129

[51] Int. Cl.[4] ..... H01F 1/04

[52] U.S. Cl. ..... 148/301; 148/313; 148/315; 420/416; 420/435; 420/581

[58] Field of Search ..... 420/435, 416, 580, 581; 148/301, 313, 315

[56] References Cited

U.S. PATENT DOCUMENTS

| | | | |
|---|---|---|---|
| 3,424,578 | 6/1967 | Strnat et al. | 148/31.57 |
| 3,546,030 | 12/1968 | Bushow et al. | 148/31.57 |
| 3,560,200 | 4/1968 | Nesbitt et al. | 148/31.57 |
| 3,615,911 | 10/1971 | Nesbitt et al. | 148/31.57 |
| 3,998,669 | 12/1976 | Strnat | 148/31.57 |
| 4,131,495 | 12/1978 | Menth et al. | 148/31.57 |
| 4,135,953 | 1/1979 | Nagel et al. | 148/103 |
| 4,192,696 | 3/1980 | Menth et al. | 148/101 |
| 4,382,061 | 5/1983 | Herget et al. | 420/435 |

FOREIGN PATENT DOCUMENTS

| | | |
|---|---|---|
| A0010960 | 10/1979 | European Pat. Off. . |
| 1225079 | 11/1969 | United Kingdom . |
| 1359313 | 8/1971 | United Kingdom . |
| A2071146 | 2/1980 | United Kingdom . |

OTHER PUBLICATIONS

Journal of Applied Physics, vol. 50, No. 3, Part 11, Mar. 1979, pp. 2346–2348, N.Y., U.S.A., H. Maeda: "Coercive Force of Pseudobinary R(Col-xCux)5 Compounds".

IEE Transactions on Magnetics, vol. MAG-13, No. 5, Sep. 1977, pp. 1333–1335, N.Y., U.S.A., K. S. V. L. Narasimhan et al., "Magnetic Anisotropy of Substituted R2C017 Compounds".

European Search Report, completed 23-09-1983, by Examiner Elsen D. B. A. at The Hague.

Ohkoshi et al-"Rotational-Type Spin Reorientation in $Nd_{1-x}Dy_xCo_5$ and Its Application to Thermomagnetic Generator"-5 Sep. 5 77-p. 1158-Tokyo, Japan.

*Primary Examiner*—John P. Sheehan

*Attorney, Agent, or Firm*—Staas & Halsey

[57] ABSTRACT

Ferromagnetic material for temperature sensitive elements or parts has a direction of easy magnetization which varies depending upon temperature. The material has the formula:

$$Nd_{1-u}R_u(Co_{1-x}M_x)_z$$

wherein R is one or more rare earth elements, M is at least one element selected from the group consisting of B, Al, Si, Ti, V, Cr, Mn, Fe, Ni, Cu, Zr, Nb, Ta, Mo, W, Hf, Pd, Sn and Pb, $0 \leqq u \leqq 0.5$, $0 < x < 0.4$ and $4.4 \leqq z \leqq 5.5$.

5 Claims, 44 Drawing Figures

MATERIAL FOR TEMPERATURE SENSITIVE ELEMENTS

This is a continuation of co-pending application Ser. No. 480,031, filed on 29 Mar. 1983, which itself is a continuation of Ser. No. 290,973, filed 7 Aug. 1981, both abandoned.

BACKGROUND OF THE INVENTION

The present invention relates to material for temperature sensitive elements or parts, and particularly to a material for temperature sensitive elements consisting of a ferromagnetic material of a rare earth cobalt compound of which the magnetic anisotropy varies depending upon the temperature.

When a ferromagnetic body of a rare earth cobalt compound is rotatable and is positioned between two permanent magnets 2a and 2b, as illustrated in FIG. 1, the ferromagnetic body 1 turns toward a fixed direction against the magnetic field generated by the permanent magnets 2a and 2b, due to the magnetic anisotropy of the ferromagnetic body 1. As the ferromagnetic body 1 is gradually heated, the body 1 of some kinds of rare earth compounds does not rotate, but the body 1 of other kinds of rare earth compounds starts rotating at a temperature of $T_1$, rotates by an angle of 90 degrees, and stops at a temperature of $T_2$. The rotation phenomenon of the ferromagnetic body is generated by variation of the easy direction of magnetization of the body by an angle of 90 degrees due to the spin reorientation depending upon temperature.

The variance of the direction of easy magnetization of the rare earth cobalt compound will now be explained in detail.

$RCo_5$ type compounds (R being a rare earth element) have the crystal structure of the hexagonal system, as illustrated in FIG. 2a. In FIG. 2a, the small circle indicates the cobalt element and the large circle having dots indicates the rare earth element. When the direction of easy magnetization of the $RCo_5$ type compound is parallel to the c-axis ([0001]direction) of the crystal, the state is indicated by the symbol "A" in FIGS. 2b and 3. When the direction of easy magnetization is in the basal plane ((0001)plane) of the crystal, the state is indicated by the symbol "P" in FIGS. 2b and 3. When the direction of easy magnetization is present between the c-axis and the basal plane, for example on a surface of an imaged cone, the state being intermediate between the A state and P state is indicated by the symbol "C" in FIGS. 2b and 3. Temperature dependence of the direction of easy magnetization of $RCo_5$ type rare earth cobalt compounds is shown in FIG. 3 (cf. the Bulletin of the Japan Institute of Metals, Vol. 16, No. 2, 1977, page 83).

As is obvious from FIG. 3, when the rare earth element is praseodymium (Pr), neodymium (Nd), terbium (Tb) or holmium (Ho), the direction of easy magnetization varies, depending upon temperature. Particularly, the direction of easy magnetization of $NdCo_5$ and $TbCo_5$ can vary from the P state to the A state via the C state. As to the rest of the $RCo_5$ type compounds, the direction of easy magnetization is constant in the A state. The broken lines in FIG. 3 denote the undetermined or presumed state of the direction of easy magnetization.

As to the $R_2Co_{17}$ type rare earth cobalt compounds, temperature dependence of the direction of easy magnetization is shown in FIG. 4 (cf. the same page of the above mentioned reference). In FIG. 4, the symbols A, C and P and the broken lines have the same meaning as explained above. The direction of easy magnetization of the $Lu_2Co_{17}$ compound only can vary from the P state to the C state. There is no $R_2Co_{17}$ type compound of which the direction of easy magnetization can vary from the P state to the A state via the C state.

The direction of easy magnetization of $Y_{1-x}Nd_xCo_5$ compound varies depending upon temperature, as illustrated in FIG. 5, when the molar ratio parameter "x" is 0.25, 0.50, 0.75 and 1. In FIG. 5, the symbol "$\beta$" indicated at the ordinate means the angle between the c-axis of the crystal and the direction of easy magnetization. As can be seen from FIG. 5, a transition temperature range wherein the angle $\beta$ varies from 90 degrees to zero degrees (i.e. the direction of easy magnetization varies from the P state to the A state) can change, depending on the composition of the rare earth elements (i.e. the molar ratio "x"). In this case, for example, the transition temperature range of $NdCo_5$ ("x" being 1) is from 230° to 285° K. (i.e. from −43° to 12° C.).

Furthermore, the direction of easy magnetization of the $DyCo_z$ compound varies depending upon temperature, as is illustrated in FIG. 6, when the molar ratio parameter "z" is 4.4, 4.6, 5.0 and 5.3. As can be seen from FIG. 6, the transition temperature range can be changed, depending the composition of the dysprosium cobalt compound (i.e. the molar ratio "z"). The data of FIG. 6 were obtained as a result of the present inventor's experiments. Test pieces of $DyCo_z$ compounds were produced in accordance with the process for producing a magnetic body proposed by the present inventors as U.S. Pat. Nos. 4,347,201 and 4,459,248 (European Patent Application No. 79302389.6 i.e., EP-A-0010960). The process is disclosed in column 6, lines 10–18, and 50–52, and column 10, lines 20–17, of U.S. Pat. No. 4,347,201, and in column 6, lines 11–19 and 51–53 and column 10, lines 20–27, of U.S. Pat. No. 4,459,248). The $DyCo_z$ compound has a disadvantage, i.e. a relative low saturation magnetization, as shown in Table 1, therefore, when the $DyCo_z$ compound body is used as a switch element of a temperature sensitive device, the switching property of the switch element is low so that the device has a disadvantageously large size.

TABLE 1

| Material | Saturation Magnetization (T) at Room Temperature |
|---|---|
| $DyCo_5$ | 0.437 |
| $NdCo_5$ | 1.228 |
| $TbCo_5$ | 0.236 |
| Thermorite* | 0.26 |
| Magnetic Shunt Alloy** | 0.24 |

*Mn—Zn system ferrite having a Curie point of 90° C.;
**Fe—Ni system alloy steel having a Curie point of 50° C.;

As can be seen in Table 1, the saturation magnetization of a $NdCo_5$ compound is the largest among the $RCo_5$ compounds of which the direction of easy magnetization can vary from the P state to the A state via the C state.

SUMMARY OF THE INVENTION

It is an object of the present invention to provide material for temperature sensitive elements or parts which have a high saturation magnetization and a transition temperature range shifted to higher temperature as compared with that of conventional rare earth cobalt compounds.

It is another object of the present invention to keep or raise the level of the saturation magnetization of the $NdCo_5$ compound.

It is still another object of the present invention to provide material for a temperature sensitive element having the direction of easy magnetization which can vary from the P state to the A state within a desired temperature range, preferably, at the ambient temperature and above.

According to the present invention, material for temperature sensitive elements or parts of which the direction of easy magnetization varies, depending upon temperature, has the formula:

$$Nd_{1-u}R_u(Co_{1-x}M_x)_z$$

wherein R is one or more rare earth elements, M is at least one element selected from the group consisting of B, Al, Si, Ti, V, Cr, Mn, Fe, Ni, Cu, Zr, Nb, Ta, Mo, W, Hf, Pd, Sn and Pb, $0 \leqq u \leqq 0.5$, $0 < x < 0.4$ and $4.4 \leqq z \leqq 5.5$.

If the molar ratio "x" is 0.4 or above, the saturation magnetization of the above mentioned material is remarkably lowered or the degree of orientation of the material (hereinafter explained) is worsened. It is preferable that the range of the molar ratio "x" is from 0.03 to 0.25.

When a part of the cobalt of the above mentioned material is replaced with the above combination of Fe and another element, the saturation magnetization of the material tends to decrease. However, when a part of the cobalt is replaced with Fe and another element, it is possible to suppress the tendency to decrease the saturation magnetization. The material containing Fe and another element, which may partly replace the cobalt, is indicated by the following formula:

$$Nd_{1-u}R_u(Co_{1-q-y}Fe_qM_y)_z$$

wherein R is one or more other rare earth elements besides Nd, M is at least one element selected from the group consisting of B, Al, Si, Ti, V, Cr, Mn, Ni, Cu, Zr, Nb, Ta, Mo, W, Hf, Pd, Sn and Pb, $0 \leqq u \leqq 0.5$, $0 < q \leqq 0.2$, $0 \leqq y \leqq 0.3$, $x = q + y$ and $4.4 \leqq z \leqq 5.5$. It is preferable that M is Al.

According to the present invention, the molar ratio "z" of the cobalt and M element(s) to the rare earth element(s) is from 4.4 to 5.5. As the molar ratio "z" increases, the transition beginning temperature $T_1$ and the transition ending temperature $T_2$ of the material of the present invention are shifted toward a higher temperature, as illustrated in FIG. 6 (hereinafter explained). If the molar ratio "z" is above 5.5, the degree of orientation of a thermal sensitive element of the material is worsened. As the molar ratio "z" decreases, the temperatures $T_1$ and $T_2$ decrease. The decrease of the temperatures $T_1$ and $T_2$ is undesirable, if the transition temperature range is brought below the ambient temperature. However, since the decrease of the temperatures $T_1$ and $T_2$ can be compensated with the addition of Al and the like, it is possible to use material having a molar ratio "z" of 4.4 or more.

Furthermore, it is possible to replace a part of the Nd with another rare earth element, such as Sm, Pr, up to a molar ratio "u" of 0.5. If the molar ratio "u" is above 0.5, the saturation magnetization is low so that such material is unsuitable for a temperature sensitive element.

DETAILED DESCRIPTION OF THE PREFERRED EMBODIMENTS

Figure 1:
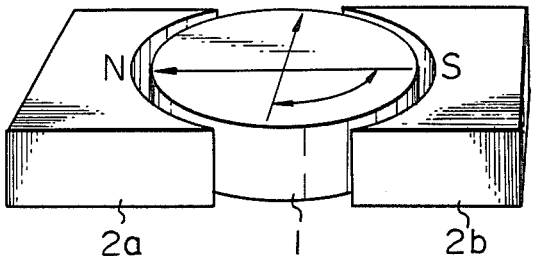
FIG. 1 is a perspective view of a rotatable ferromagnetic body and two permanent magnets.
Figure 2A:
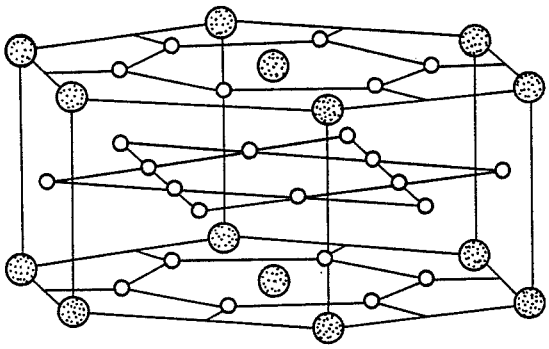
FIGS. 2*a* and 2*b* illustrate a crystal structure and states of the direction of easy magnetization of an $RCo_5$ type rare earth cobalt compound, respectively.
Figure 2B:
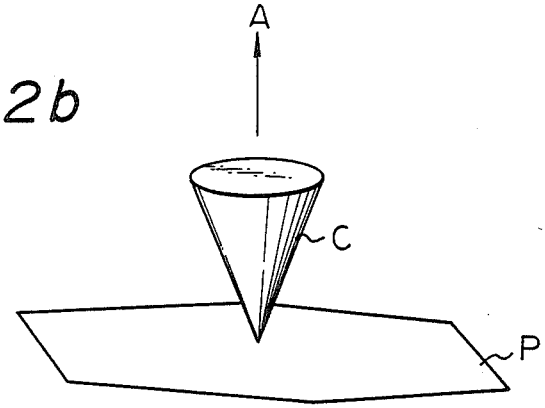
Figure 3:
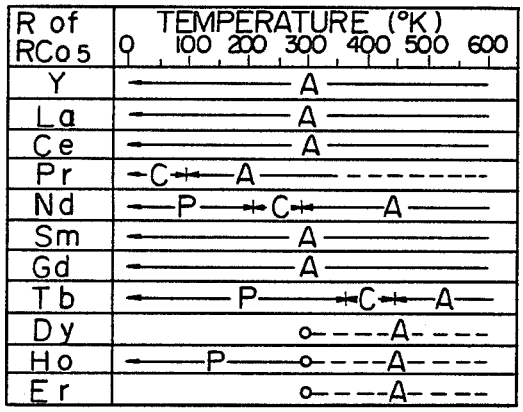
FIG. 3 is a graph showing the temperature dependence of the direction of easy magnetization of $RCo_5$ type compounds.
Figure 4:
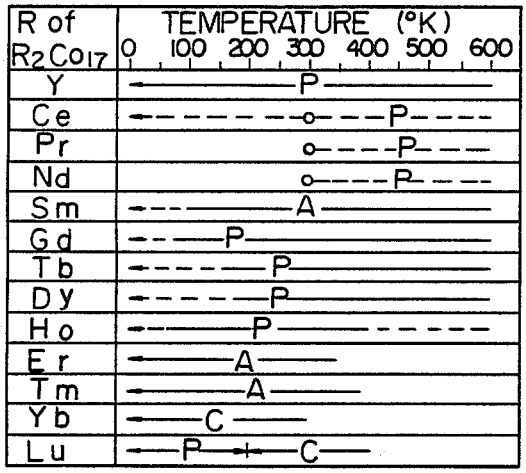
FIG. 4 is a graph showing the temperature dependence of the direction of easy magnetization of $R_2Co_{17}$ type compounds.
Figure 5:
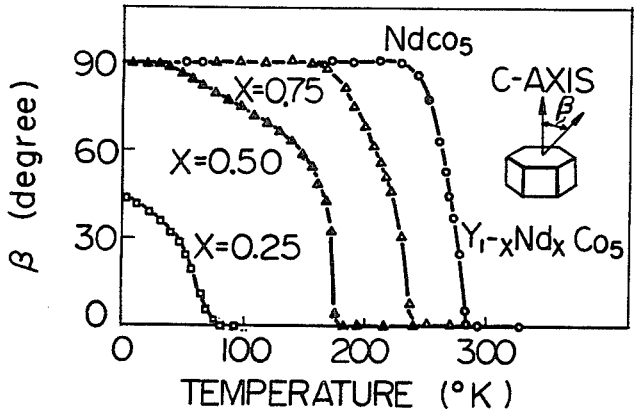
FIG. 5 is a graph showing the temperature dependence of the direction of easy magnetization of $Y_{1-x}Nd_xCo_5$ compounds.

The present invention will now be explained by examples and comparative experiments.

Example 1

Starting materials of neodymium and, if necessary, another rare earth element, cobalt and at least one element of B, Al, Si, Ti, V, Cr, Mn, Fe, Ni, Cu, Zr, Nb, Ta, Mo, W, Hf, Pd, Sn and Pb were caused to be molten at a temperature of from 1300° to 1500° C. under an inert gas atmosphere by an arc-melting or induction melting method. The melt was cast into a mold to form an ingot having a predetermined composition. The ingot was ground to a fine powder having a grain size of a single magnetic domain. The grains of fine powder were oriented by applying a magnetic field at 150° C. to arrange the direction of easy magnetization of each grain of the fine powder in one direction. Then, the fine powders were sintered at a temperature above 1000° C. and heat-treated to produce a test piece of a temperature sensitive element, as disclosed in the above U.S. Pat. Nos. 4,347,201 and 4,459,248. Composition, transition beginning temperature $T_1$, transition ending temperature $T_2$ and saturation magnetization of the obtained test pieces are shown in Table 2. At the temperature $T_1$ the direction of easy magnetization of the test piece begins to leave from the basal plane of the crystal, as the temperature of the test piece rises. At the temperature $T_2$ the direction of easy magnetization reaches the c-axis of the crystal. The basal plane and the c-axis form a right angle. Namely, as the temperature of the test piece rises, the direction of easy magnetization varies from the P state to the A state via the C state. In Table 2, enumerated drawings show the temperature dependence of the direction of easy magnetization of each of the test pieces.

TABLE 2

| Sample No. | Composition | $T_1$ $T_2$ (°C.) | Saturation Magnetization (T) | FIG. Number of the Drawing |
|---|---|---|---|---|
| 1 | $Nd(Co_{0.97}B_{0.03})_5$ | −5~13 | 0.8 | 7 |
| 2 | $Nd(Co_{0.92}Al_{0.08})_5$ | 15~36 | 1.05 | 8 |
| 3 | $Nd(Co_{0.88}Al_{0.12})_5$ | 28~47 | 0.92 | 9 |
| 4 | $Nd(Co_{0.97}Al_{0.03})_5$ | 1~22 | 1.33 | 10 |
| 5 | $Nd(Co_{0.97}Si_{0.03})_5$ | 12~30 | 0.76 | 11 |
| 6 | $Nd(Co_{0.97}V_{0.03})_5$ | 0~19 | 1.03 | 12 |
| 7 | $Nd(Co_{0.97}Cr_{0.03})_5$ | −10~7 | 1.02 | 13 |
| 8 | $Nd(Co_{0.97}Mn_{0.03})_5$ | −38~−15 | 1.08 | 14 |
| 9 | $Nd(Co_{0.75}Cu_{0.25})_5$ | −5~25 | 0.95 | 15 |
| 10 | $Nd(Co_{0.97}Zr_{0.03})_5$ | −11~5 | 1.15 | 16 |
| 11 | $Nd(Co_{0.97}Nb_{0.03})_5$ | −15~14 | 1.19 | 17 |
| 12 | $Nd(Co_{0.97}Mo_{0.03})_5$ | −2~15 | 1.12 | 18 |
| 13 | $Nd(Co_{0.97}Pd_{0.03})_5$ | −12~11 | 0.86 | 19 |
| 14 | $Nd(Co_{0.97}Sn_{0.03})_5$ | −25~11 | 0.81 | 20 |
| 15 | $Nd(Co_{0.95}Ni_{0.05})_5$ | −11~13 | 1.06 | 21 |
| 16 | $Nd(Co_{0.95}Fe_{0.05})_5$ | −4~12 | 1.15 | 22 |
| 17 | $Nd(Co_{0.90}Fe_{0.10})_5$ | −2.5~12 | 1.20 | 23 |
| 18 | $Nd(Co_{0.97}Hf_{0.03})_5$ | −12.5~2.5 | 1.12 | 24 |
| 19 | $Nd(Co_{0.97}Ta_{0.03})_5$ | −12.5~8 | 1.15 | 25 |
| 20 | $Nd(Co_{0.97}W_{0.03})_5$ | 0~15 | 1.08 | 26 |
| 21 | $Nd(Co_{0.97}Pb_{0.03})_5$ | −10~17.5 | 0.78 | 27 |
| 22 | $Nd(Co_{0.97}Ti_{0.03})_5$ | −4~14.5 | 1.00 | 28 |
| 23 | $Nd(Co_{0.87}Fe_{0.05}Al_{0.08})_5$ | 29~48 | 1.18 | 29 |
| 24 | $Nd(Co_{0.82}Fe_{0.10}Al_{0.08})_5$ | 49~61 | 1.24 | 30 |
| 25 | $Nd(Co_{0.83}Fe_{0.05}Al_{0.12})_5$ | 46~64 | 0.93 | 31 |
| 26 | $Nd(Co_{0.78}Fe_{0.10}Al_{0.12})_5$ | 75~85 | 1.07 | 32 |
| 27 | $Nd(Co_{0.87}Fe_{0.05}Al_{0.08})_{4.6}$ | 26~45 | 1.12 | 33 |
| 28 | $Nd(Co_{0.87}Fe_{0.05}Al_{0.08})_{5.3}$ | 36~54 | 1.20 | 34 |
| 29 | $Nd(Co_{0.87}Fe_{0.05}Al_{0.08})_{5.5}$ | 37~58 | 1.21 | 35 |
| 30 | $Nd_{0.9}Sm_{0.1}(Co_{0.87}Fe_{0.05}Al_{0.08})_5$ | −30~−5 | 1.17 | 36 |
| 31 | $Nd_{0.9}Sm_{0.1}(Co_{0.83}Fe_{0.05}Al_{0.12})_{5.3}$ | 40~61 | 1.20 | 37 |
| 32 | $Nd_{0.9}Pr_{0.1}(Co_{0.87}Fe_{0.05}Al_{0.08})_5$ | 10.5~30 | 1.18 | 38 |
| 33 | $Nd_{0.9}Pr_{0.1}(Co_{0.83}Fe_{0.05}Al_{0.12})_5$ | 31~47.5 | 1.06 | 39 |
| * | $NdCo_5$ | −7~13 | 1.2 | — |

*Comparative example

In Table 2, the saturation magnetization is indicated by intensity of magnetization at a magnetic field intensity of 1.2 MA/m.

Example 2

Figure 40:
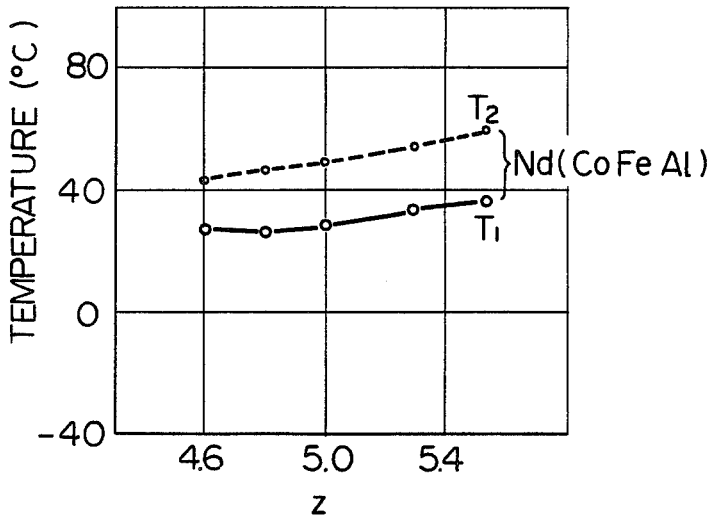
FIG. 40 is a graph showing the relationship between the transition beginning and ending temperatures $T_1$ and $T_2$ and the molar ratio "z"

Test pieces of $Nd(Co_{0.87}Fe_{0.05}Al_{0.08})_z$ were produced in the same manner as that mentioned in Example 1. The molar ratio "z" was 4.6(sample 27), 4.8, 5.0(sample 23), 5.3(sample 28) and 5.5(sample 29). The temperatures $T_1$ and $T_2$ are shown in FIG. 40. As can be seen from FIG. 40, the transition temperature range of the material indicated by the above formula varies, depending upon the molar ratio "z".

Example 3

Figure 6:
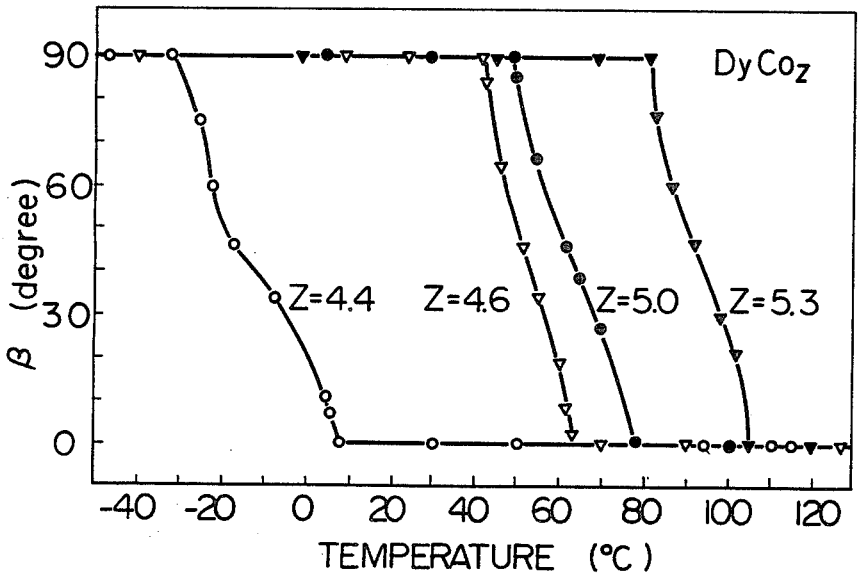
FIG. 6 is a graph showing the temperature dependence of the direction of easy magnetization of $DyCo_z$ compounds.
Figure 7:
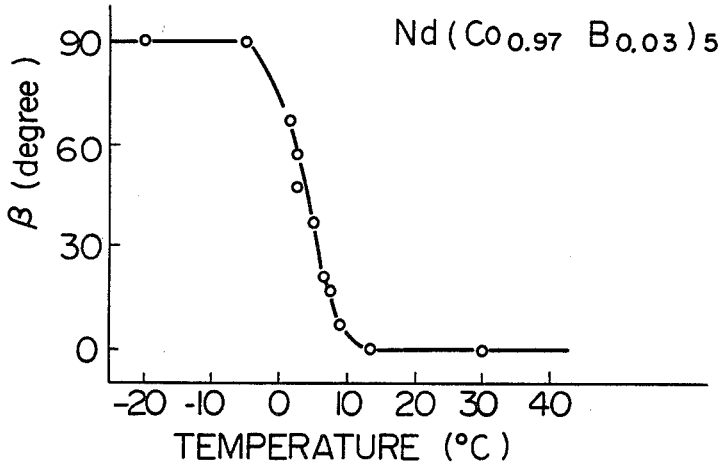
FIGS. 7 through 39 are graphs showing the temperature dependence of the direction of easy magnetization of NdR(CoM) compounds, which have compositions described in Table 2, respectively.
Figure 8:
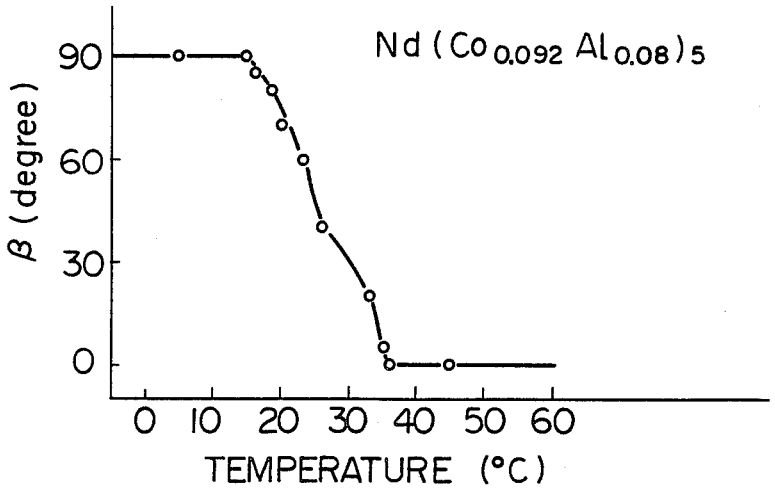
Figure 9:
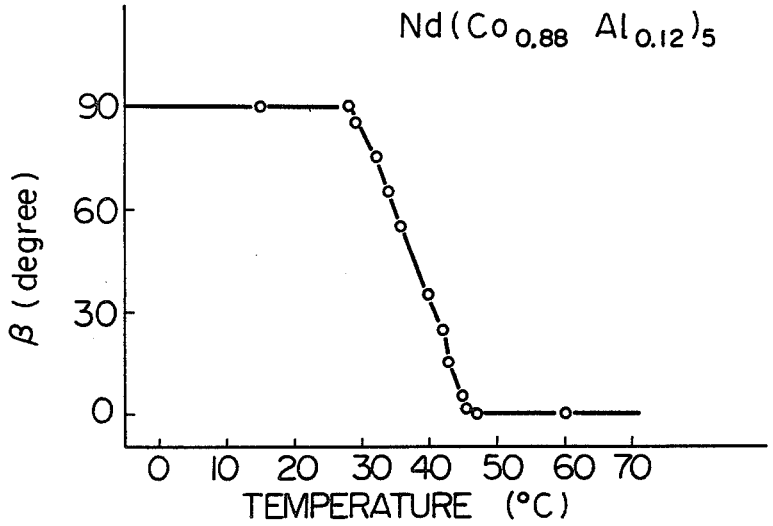
Figure 10:
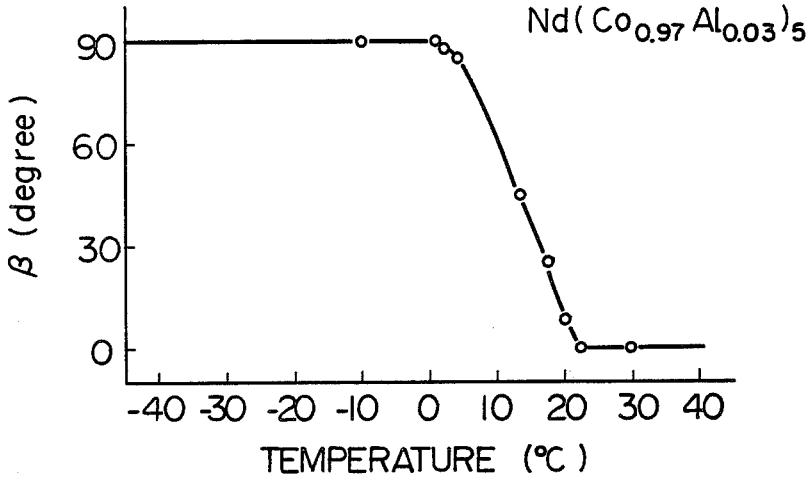
Figure 11:
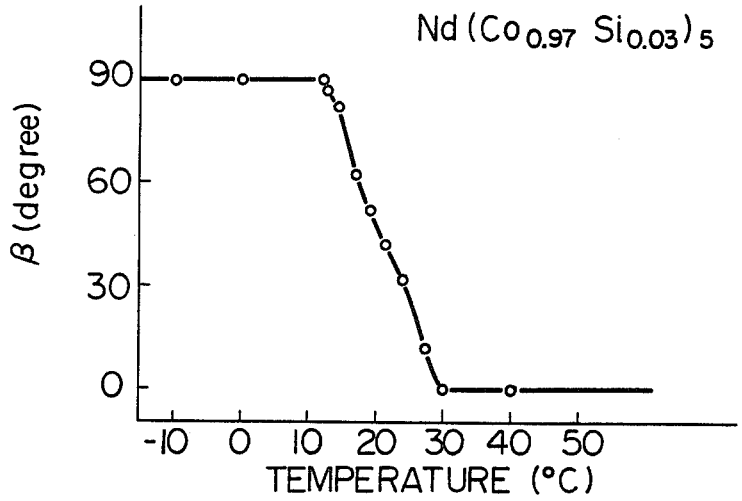
Figure 12:
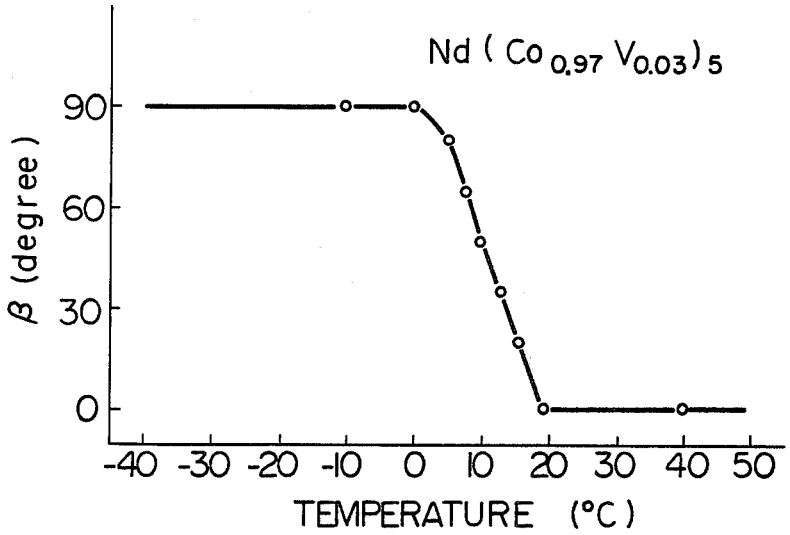
Figure 13:
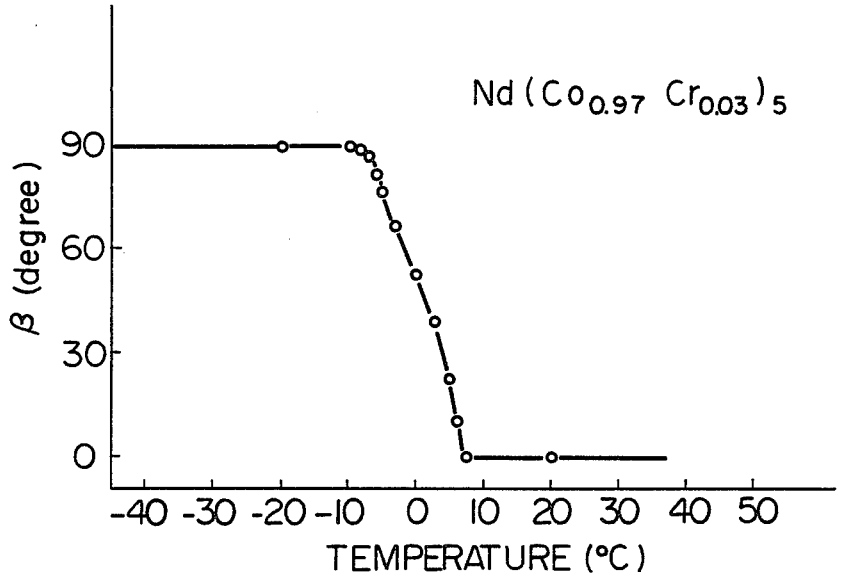
Figure 14:
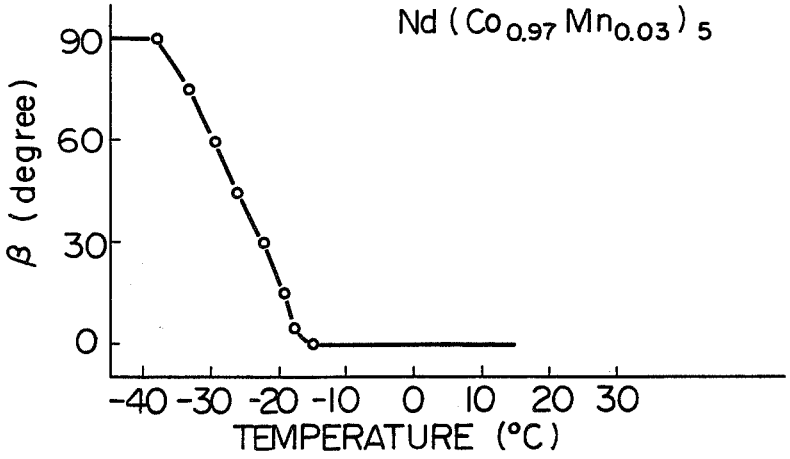
Figure 15:
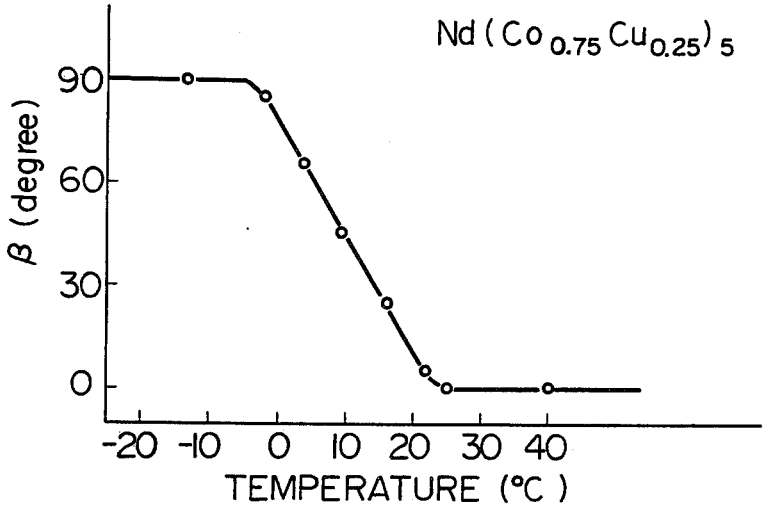
Figure 16:
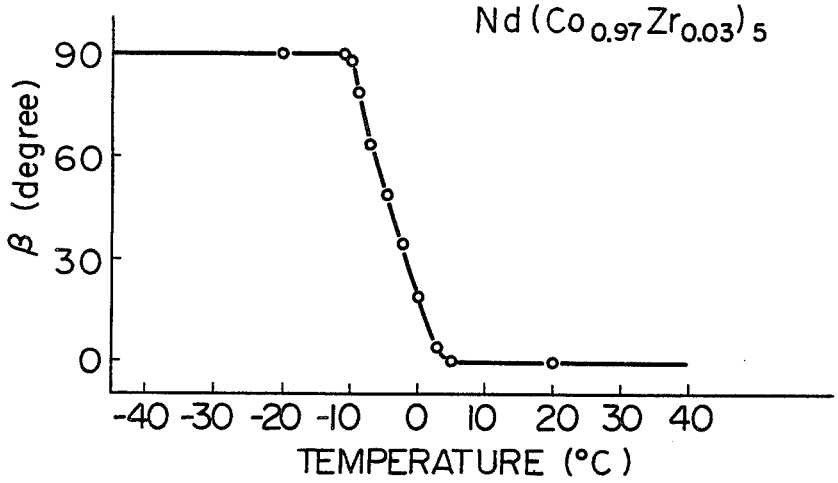
Figure 17:
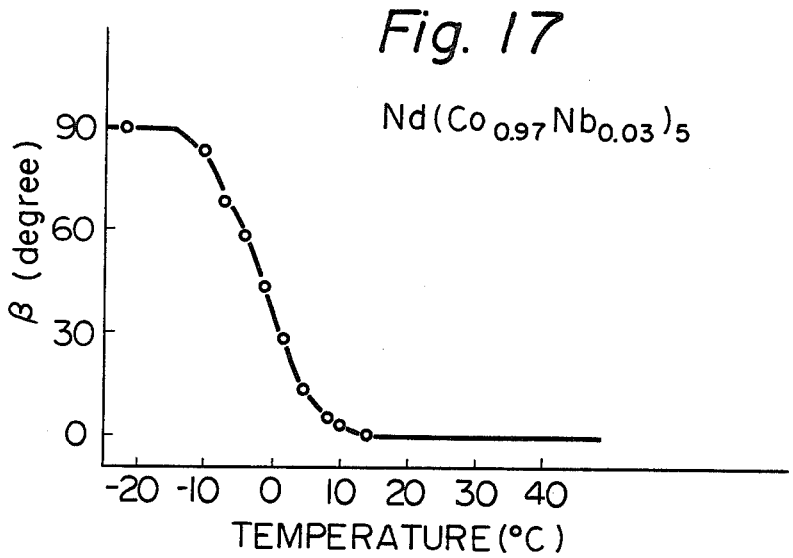
Figure 18:
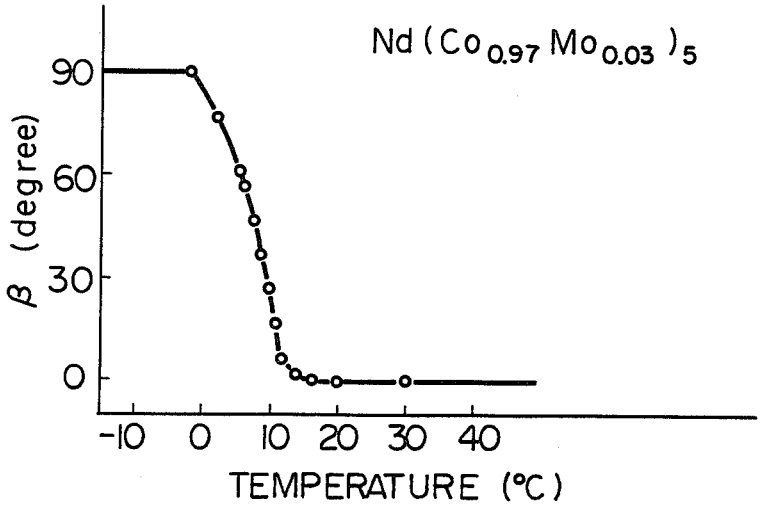
Figure 19:
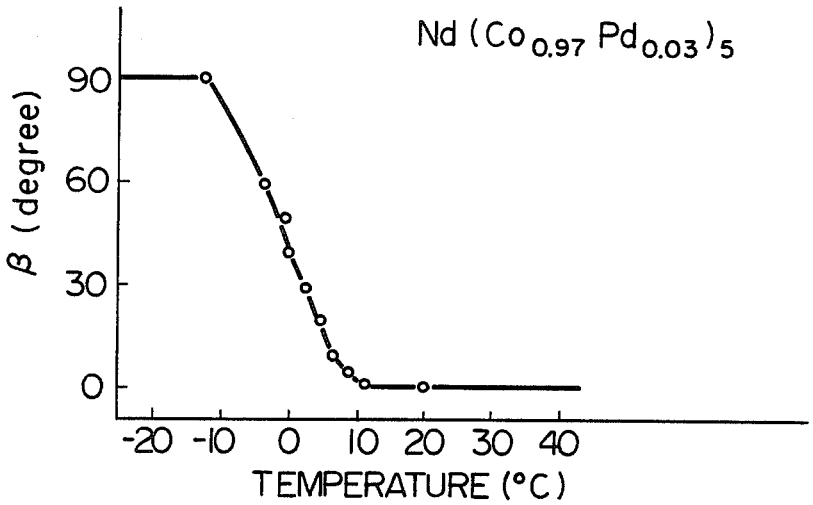
Figure 20:
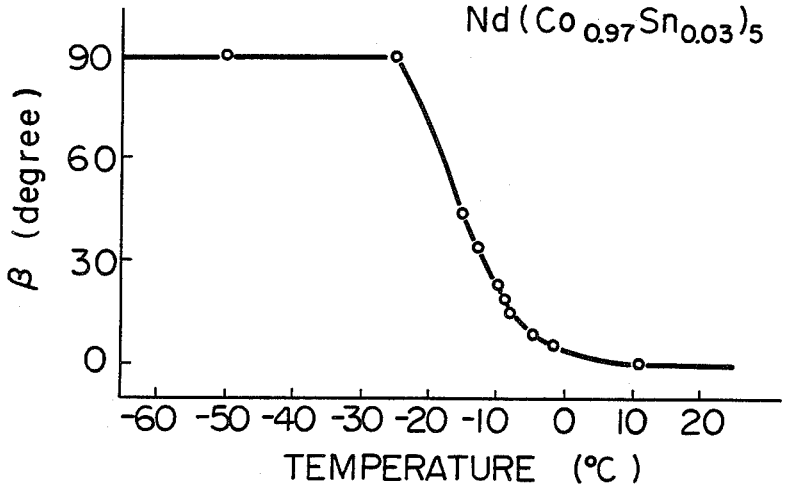
Figure 21:
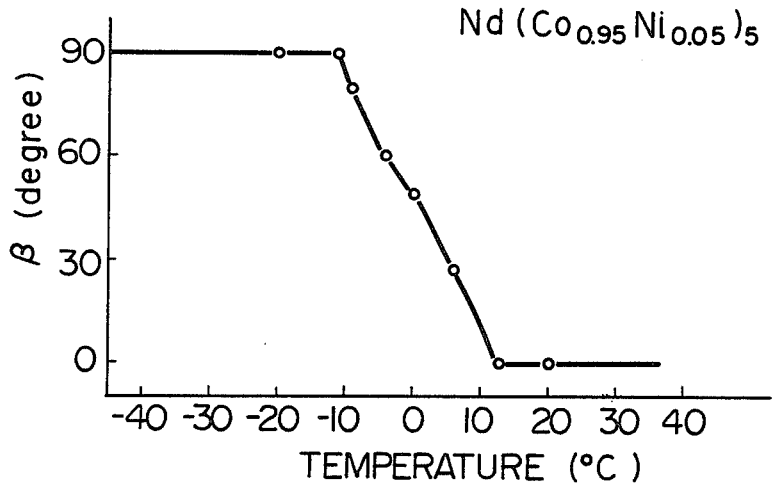
Figure 22:
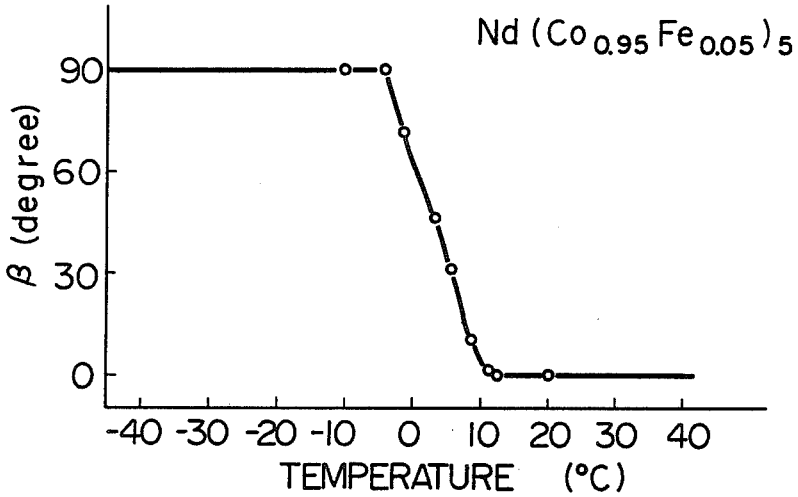
Figure 23:
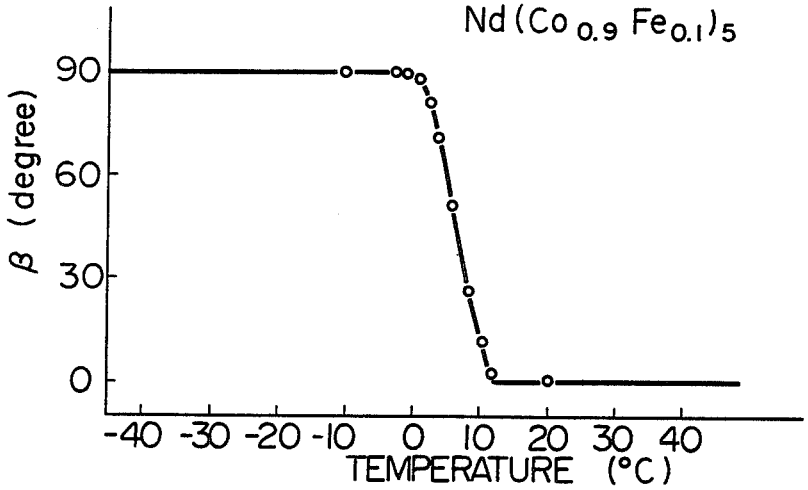
Figure 24:
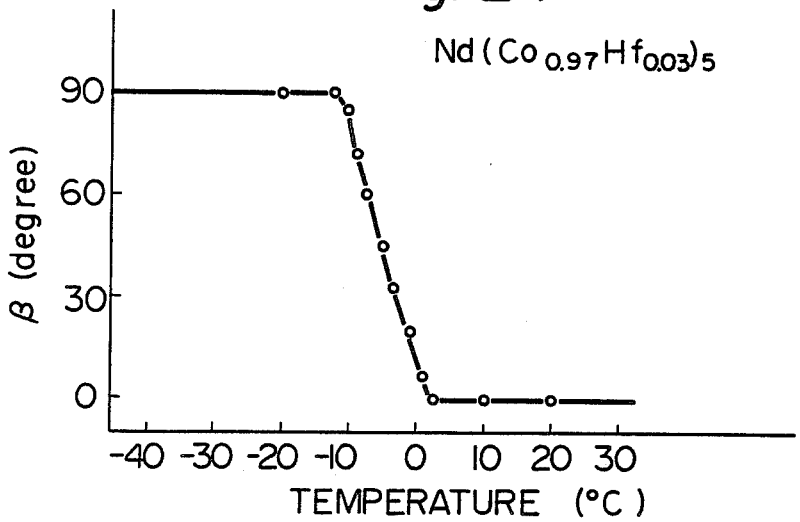
Figure 25:
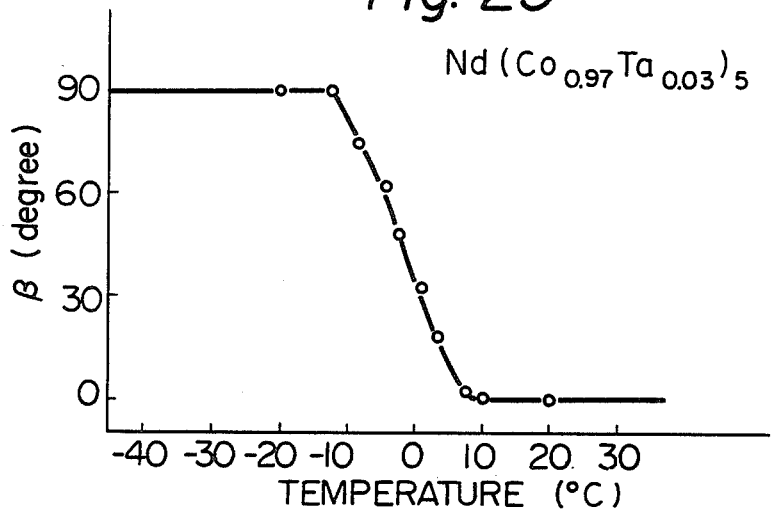
Figure 26:
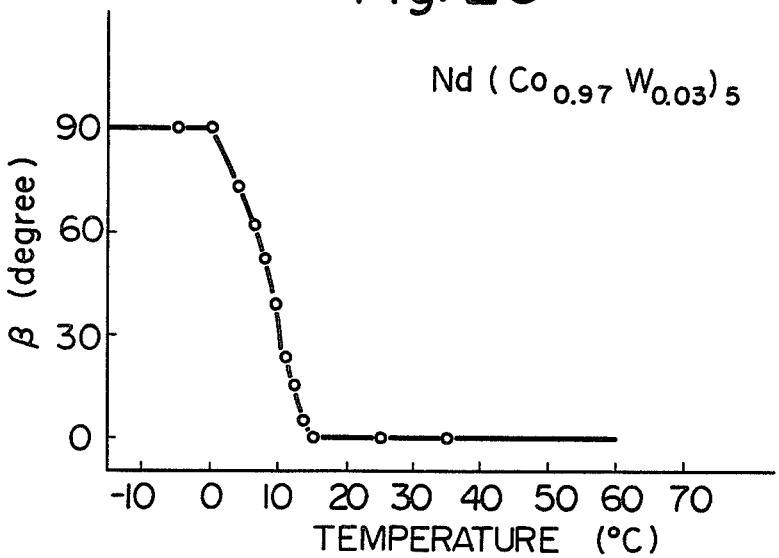
Figure 27:
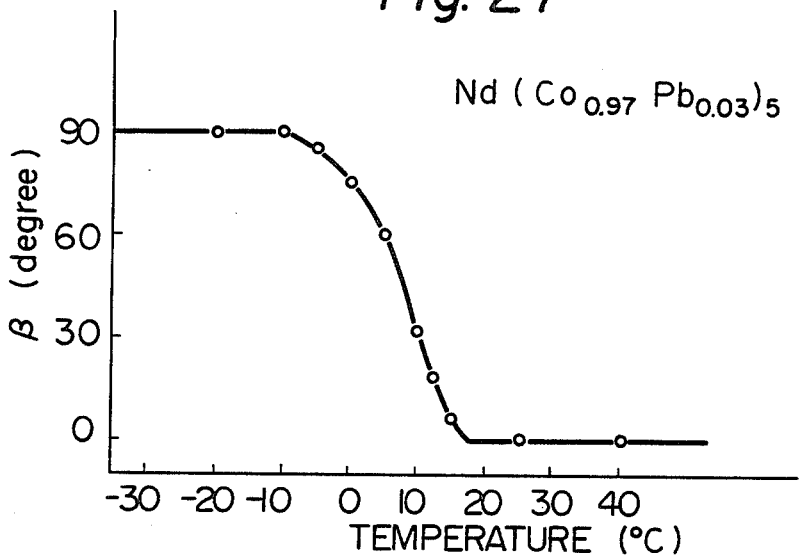
Figure 28:
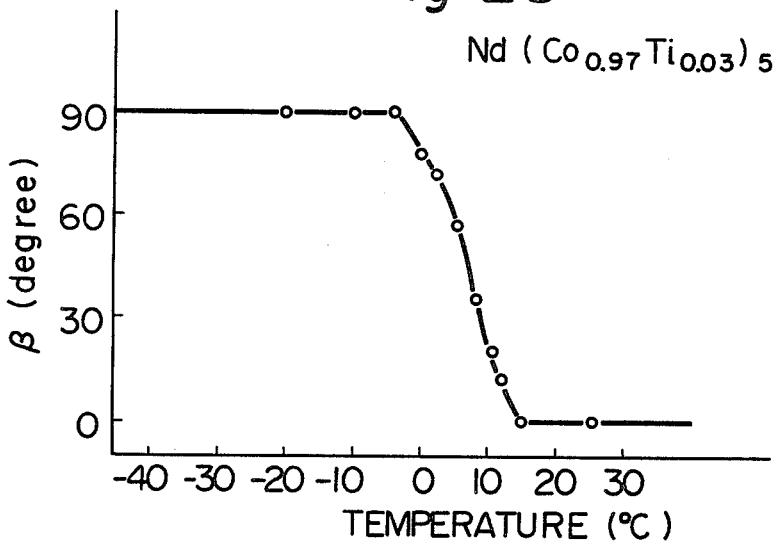
Figure 29:
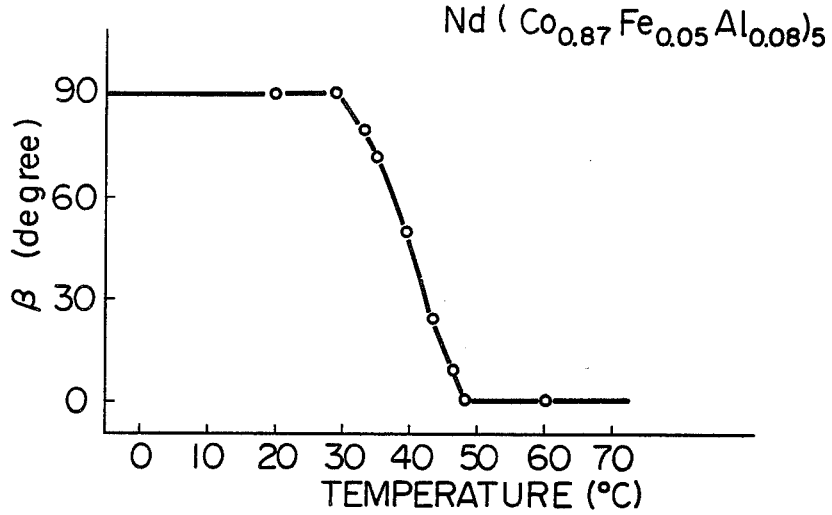
Figure 30:
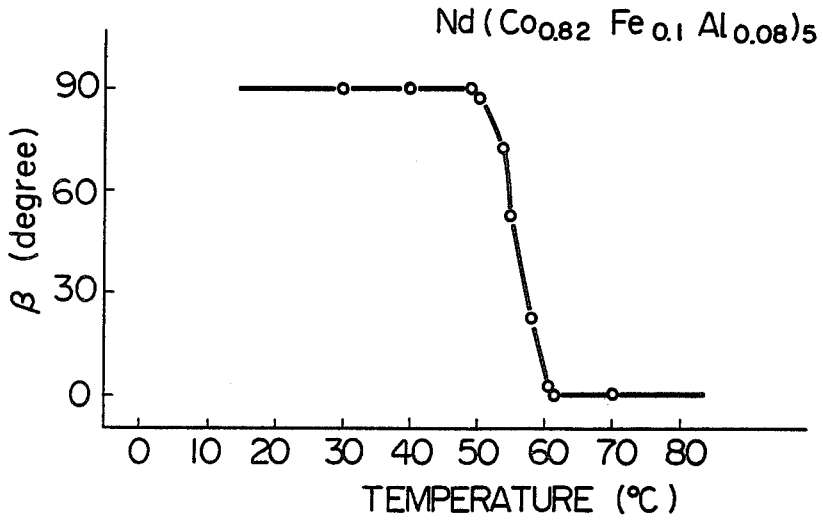
Figure 31:
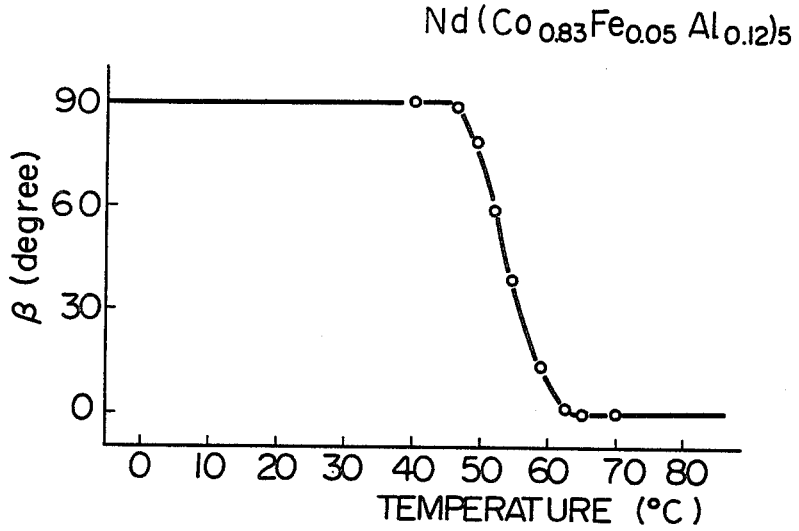
Figure 32:
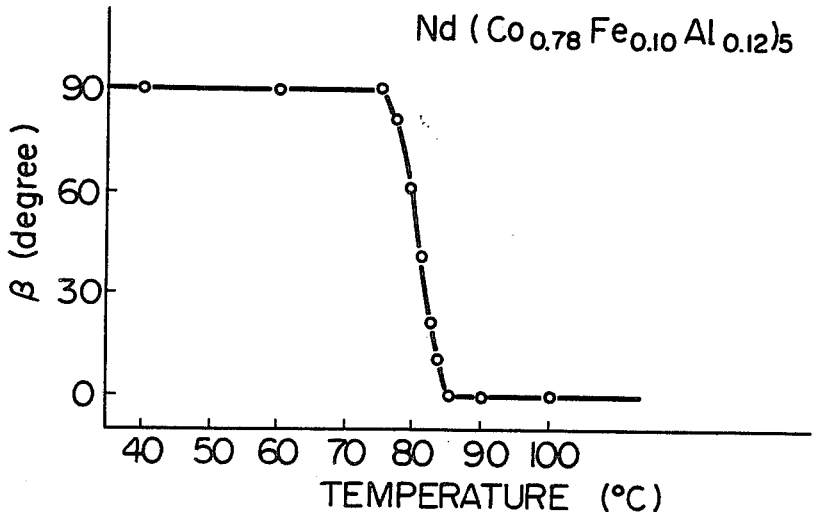
Figure 33:
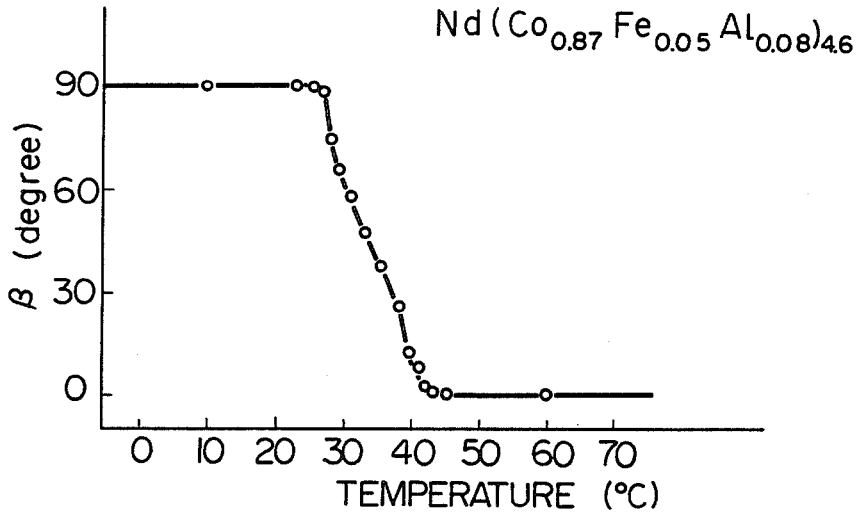
Figure 34:
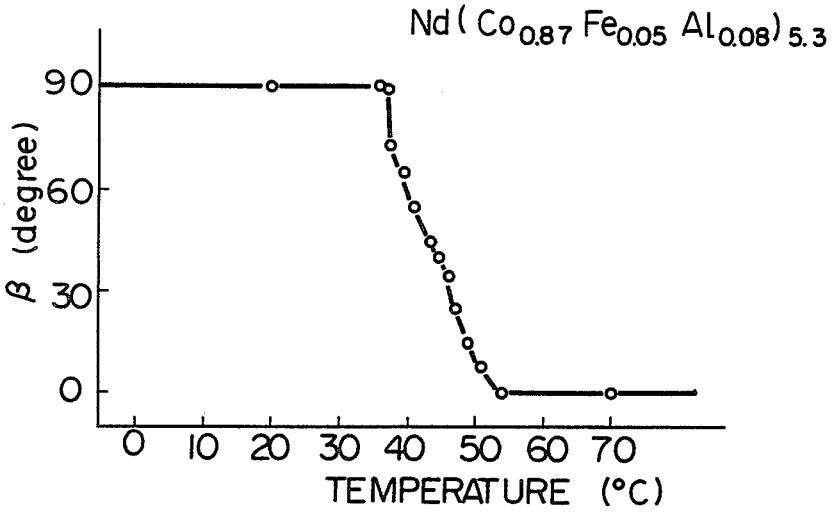
Figure 35:
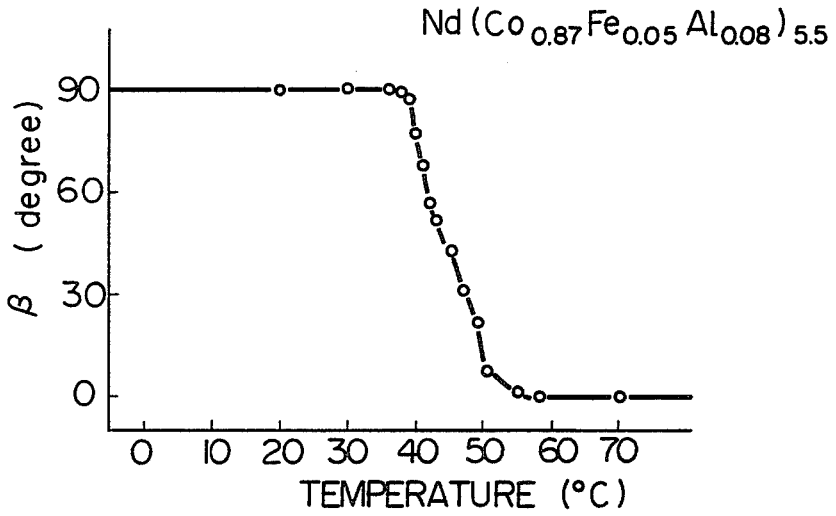
Figure 36:
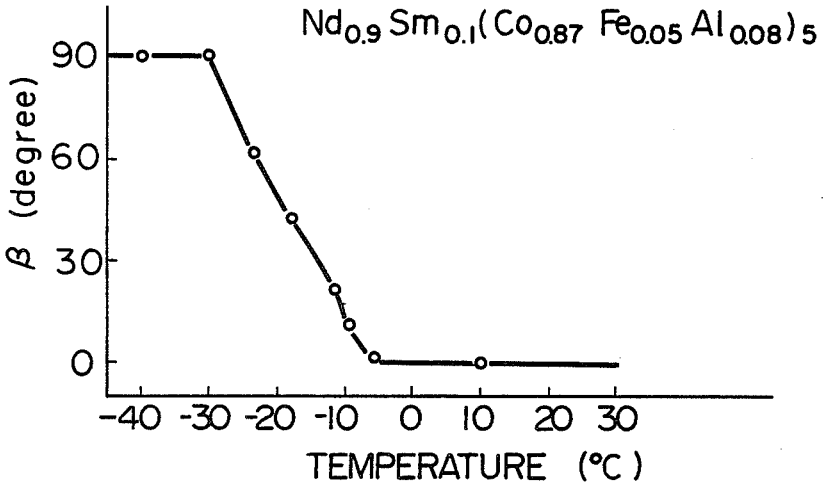
Figure 37:
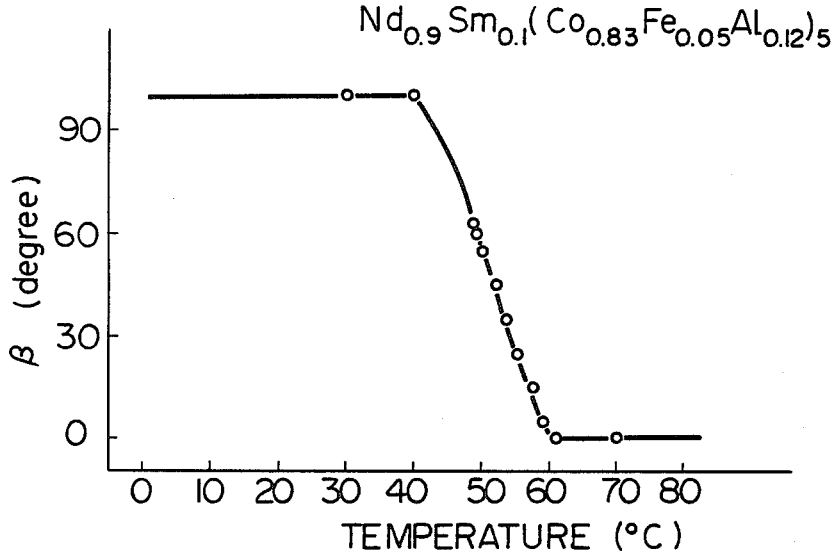
Figure 38:
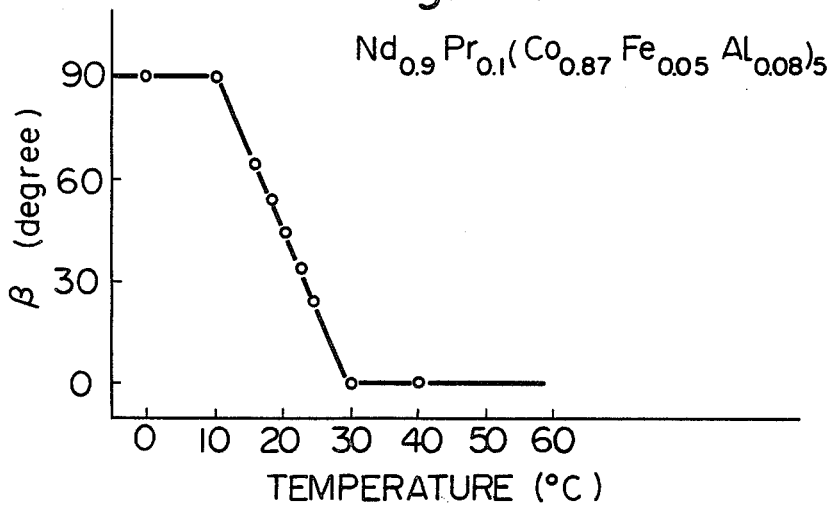
Figure 39:
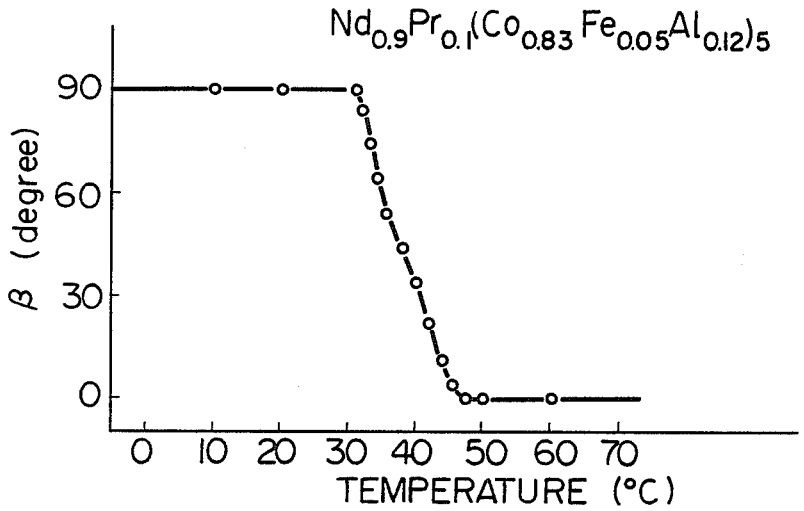
Figure 41:
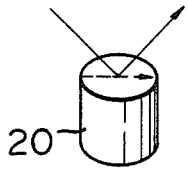
FIG. 41 is a perspective view of a sintered body to be measured by the X-ray diffraction method.
Figure 42:
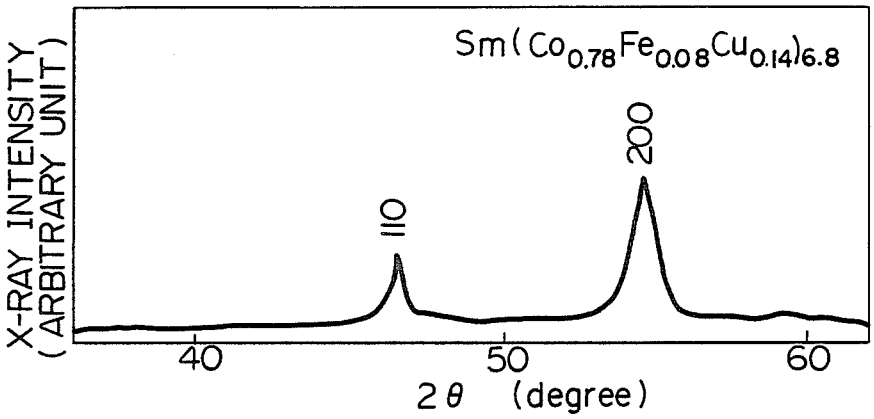
FIG. 42 is a graph showing a diffraction pattern of a sintered body of $Sm(CoFeCu)_{6.8}$ compound.
Figure 43:
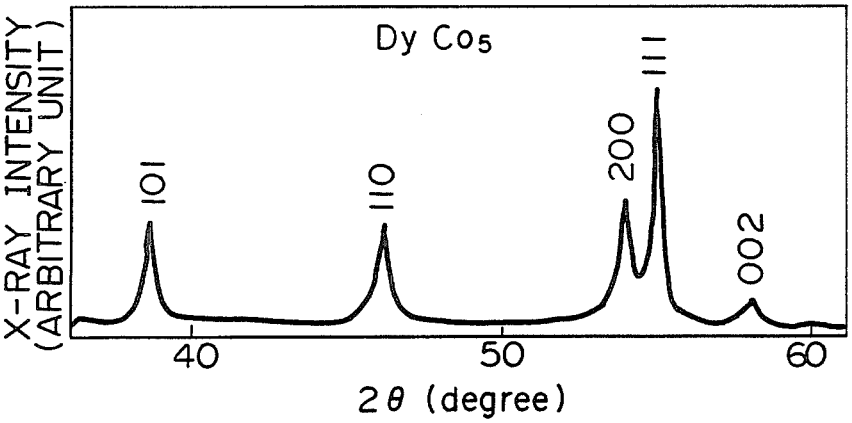
FIG. 43 is a graph showing a diffraction pattern of a sintered body of $DyCo_5$ compound.

When the degree of orientation of a sintered body 20 (FIG. 41) is measured by the X-ray diffraction method, X-rays (indicated by a solid arrow) irradiate a bottom surface to obtain a diffraction pattern. If the c-axis of the material of the sintered body 20 is arranged in a predetermined direction (e.g. a certain diameter direction, indicated by a broken arrow in FIG. 41) of the bottom surface, peaks from the (h k·0) type lattice plane only appear in the diffraction pattern, and there are no peaks from the (00·m) type lattice plane which is at right angles to the c-axis. For example, powders of $Sm((Co_{0.78}Fe_{0.08}Cu_{0.14})_{6.8}$ are pressed in a magnetic field, and then are sintered to form a body. The sintered body is measured by the X-ray diffraction method to obtain a diffraction pattern, as illustrated in FIG. 42. The sintered body is a permanent magnet having a good rectangular hysteresis loop and has the c-axis arranged in one direction. As can be seen from FIG. 42, when the degree of orientation of the sintered body is superior, peaks of the (h k·0) plane only appear in the diffraction pattern. When a sintered body of $DyCo_5$ compound (in FIG. 6) is measured by the X-ray diffraction method, a diffraction pattern is obtained having peaks diffracted from the (h k.0) plane, as illustrated in FIG. 43. Therefore, it is found that the degree of orientation of the sintered body is inferior. When the orientation of the sintered body is disordered, the peak of the (111) plane sensitively appears in the diffraction pattern. In FIG. 43, the peak of the (200) plane is near (on the left side of) the peak of the (111) plane, and is of a lesser degree. The high ratio of the heights of the two peaks $I_{111}/I_{200}$ indicates the degree of orientation.

The samples 4, 6, 7, 8, 9 and 10 (in Table 2) of the $Nd(Co_{0.97}M_{0.03})_5$ compound were measured by the X-ray diffraction method to obtain the degree of orientation thereof in Table 3.

TABLE 3

| Sample No. | Element of M in NdCoM compound | $I_{111}/I_{200}$ |
|---|---|---|
| 4 | Al | 0.10 |
| 6 | V | 0.62 |
| 7 | Cr | 0.36 |
| 8 | Mn | 0.38 |
| 10 | Zr | 0.67 |
| 11 | Nb | 0.58 |

As can be seen from Tables 2 and 3, as the degree of orientation of the material becomes superior, i.e. the ratio of $I_{111}/I_{200}$ becomes small, and the saturation magnetization becomes large.

We claim:

1. A temperature sensitive element which comprises a sintered powder of fine grains consisting of a spin reorientation type ferromagnetic material having a transition temperature range $T_2-T_1$ defined between transition beginning and ending temperatures $T_1$, $T_2$, below which transition beginning temperature $T_1$ the easy direction of magnetization of said material is in a first predetermined crystallographic direction and above which transition ending temperature $T_2$ the easy direction of magnetization is in a second predetermined crystallographic direction that is perpendicular to the first predetermined crystallographic direction, said material having the formula:

$$Nd_{1-u}R_u(Co_{1-x}M_x)_z$$

wherein R is one element selected from the group consisting of Sm and Pr, M is Al or Al and Fe, $0 \leqq u \leqq 0.5$, $0 < x < 0.4$, and $4.4 \leqq z \leqq 5.5$.

2. The element of claim 1, wherein said transition beginning and ending temperatures increase with increasing amount of said Al.

3. The element of claim 1, wherein said M comprises said Al and said Fe, and a saturation magnetization of said element increases with increasing amount of said Fe.

4. The element of claim 1, wherein said M comprises said Al and said Fe, and said beginning and ending transition temperatures increase with increasing amount of said Al.

5. The element of claim 1, having a saturation magnetization corresponding to approximately 1.3 T at a magnetic field intensity of 1.2 MA/m.

* * * * *